United States Patent [19]

Chapman et al.

[11] 4,372,751

[45] Feb. 8, 1983

[54] COAL-OIL MIXTURE APPARATUS

[75] Inventors: Wilson M. Chapman, Long Beach; Norman L. Jensen, Jr., Irvine, both of Calif.

[73] Assignee: Occidental Engineering Corporation, Irvine, Calif.

[21] Appl. No.: 214,366

[22] Filed: Dec. 8, 1980

[51] Int. Cl.[3] ..... C10L 11/08; C10L 1/32

[52] U.S. Cl. ..... 44/2; 241/101.5; 241/105; 241/109; 406/39

[58] Field of Search ..... 44/2, 51; 75/42; 241/101.5, 105, 109; 406/39

[56] References Cited

U.S. PATENT DOCUMENTS

| | | | |
|---|---|---|---|
| 1,975,631 | 10/1934 | Bonfield | 44/51 |
| 2,059,535 | 11/1936 | Russell | 44/51 X |
| 3,241,505 | 3/1966 | Long et al. | 44/51 X |
| 3,618,866 | 11/1971 | Robinson | 241/101.5 |

FOREIGN PATENT DOCUMENTS

| | | | |
|---|---|---|---|
| 155209 | 4/1922 | United Kingdom | 44/2 |

*Primary Examiner*—Carl F. Dees

*Attorney, Agent, or Firm*—Walter A. Hackler

[57] ABSTRACT

Apparatus for producing a coal-oil mixture at varying output rates corresponding to a variable demand includes crushing means for pulverizing coal at a variable rate and mixing means, interconnected with the crushing means and a supply of oil, for producing the coal-oil mixture (COM), the coal being suspended in the oil. Control means is provided for receiving input signals corresponding to desired production rates of the COM and in an operative relationship with the crushing and mixing means for varying the rate of pulverized coal production and the mixing rate to produce the COM at rates corresponding to the input signals. The apparatus is configured for disposal on mobile platforms and includes a separable interconnecting conduit means between the crushing means, mixing means and control means for enabling transportation of the apparatus from one site to another on the mobile platform.

13 Claims, 3 Drawing Figures

COAL-OIL MIXTURE APPARATUS

BACKGROUND

This invention relates generally to apparatus for producing coal-oil mixtures, and, more particularly, to apparatus for on-line production of coal-oil mixtures at varying output rates in response to a variable demand.

Generally, a coal-oil mixture (COM) is a hybrid fuel consisting of pulverized coal suspended in Number 4 or 6 fuel oil. The coal content of a typical COM may be as high as approximately 55 percent by weight of 80 percent minus 200 mesh coal.

Use and development of COM began in the late 1800's and has continued on a sporatic basis until recently. When world oil shortages prompted more intense interest. Presently, COM is being considered as an alternate fuel in boilers, blast furnaces, and kilns, as well as other applications.

A major problem with using coal-oil mixtures as fuel is the stability of the mixture. That is, without continued agitation of the COM the coal comes out of suspension and settles to the bottom of storage vessels. Such continuous agitation of stored COM is costly in terms of both energy and equipment.

A number of factors relate to the stability of the coal in the coal-oil mixture.

It is evident that the finer the coal is pulverized, the greater the stability of the coal-oil mixture. However, the finer coal is pulverized, the greater the possibility of explosion hazards attendant with pulverizing, storing, and handling of the coal. In addition, although COM made with very fine grinds of coal, may have better stability, the power cost to pulverize the coal to smaller particle size may not be economically feasible. High coal concentration in a COM is desirable from the standpoint of providing a cheaper fuel, however, coal settling may be more difficult to prevent.

A significant market for COM exists in blast furnace and kiln applications such as, for example, those used in the hot metal and pelletizing industries. In fact, based on 1976 figures for annual hot metal and pellet production, an estimate of fuel consumption for these two applications is approximately $7.1\times10^6$ gallons per day of fuel oil. If a hybrid fuel, utilizing as little as 40 percent coal in a COM were used in lieu of straight fuel oil, approximately 24 million barrels of fuel oil per year could be replaced by COM.

In operation, blast and kiln furnaces may require a sizable fuel surge capacity of start up, and experience frequent shut-downs during production or for maintenance.

COM produced at a fixed location and either tanked or piped to blast and kiln furnaces is not suitable because of required storage of the fuel before use. As previously mentioned, users experiencing frequent shut-downs and a variable demand or surge requirement, may require the COM to be stored over periods of time during which the coal settles from the oil, rendering the COM unusable without resuspension of the coal.

Significant efforts have been made to stabilize coal-oil mixtures. These efforts include the addition of various types of agents to the COM in order to prevent the coal from settling during the storage period. A primary disadvantage of this method of stabilizing COM is the cost of such additives. Additional efforts have been made using ultrasonic techniques to form coal-oil dispersions which are stable over extended periods but these too have yet to be proven successful.

Hence, there is need for an apparatus that can supply COM at variable rates to blast furnaces and the like while eliminating large storage tanks and the use of expensive additives and apparatus for stabilizing the COM. A further use and advantage of the apparatus, when configured for transfer from site to site, is for producting a temporary supply of COM for use in evaluating the feasibility of using COM in various types of pre-existing fuel burning apparatus.

SUMMARY OF THE INVENTION

In accordance with the present invention, apparatus for producing a coal-oil mixture includes crushing means for producing pulverized coal at a variable rate and mixing means adapted for connection to an external oil supply and interconnected with the crushing means for producing the coal-oil mixture at a variable mixing rate. The coal in the coal-oil mixture (COM) is suspended in the COM by the mixing means.

Control means, configured for receiving input signals corresponding to desired production rates of the COM is in an operative relationship with the crushing and mixing means for varying the rate of supply of pulverized coal to produce the COM at rates corresponding to the input signals.

In particular, the mixing means may include an oil-water emulsifier adapted for connection to external water and oil supplied to produce an oil-water emulsion at a variable first mixing rate. It is believed that the water aids in the dispersion of the coal particles in oil and also acts as a combustion aid in the burning of the COM. The mixing means includes means for combining the pulverized coal and the oil-water emulsion to produce a coal-oil mixture at a variable second mixing rate, and the apparatus includes first conduit means for conveying the pulverized coal to the second mixing means and second conduit means for conveying the coal-oil-water dispersion to the second mixing means. Both the first and second conduit means are configured for separation and reconnection for enabling modular transportation of the apparatus from one site to another. The control means is configured for receiving input signals corresponding to desired production rates of coal-oil mixture and is in an operative relationship with the crushing means, the emulsifier, the second mixing means and the first and second conduit means for varying the rate of pulverized coal production, the first mixing rate and the second mixing rate to produce the COM at rates corresponding to the input signals. The control means include separable interconnecting means between the crushing means, first and second mixing means and the first and second conduit means for enabling module transportation of the apparatus from one site to another. It is to be appreciated that by enabling modular transportation of the apparatus the apparatus is suitable for use in evaluating the use of COM in various applications at different sites.

BRIEF DESCRIPTION OF THE DRAWINGS

The advantages and features of the present invention will be better understood by the following description and drawing in which.

DETAILED DESCRIPTION

Figure 1:
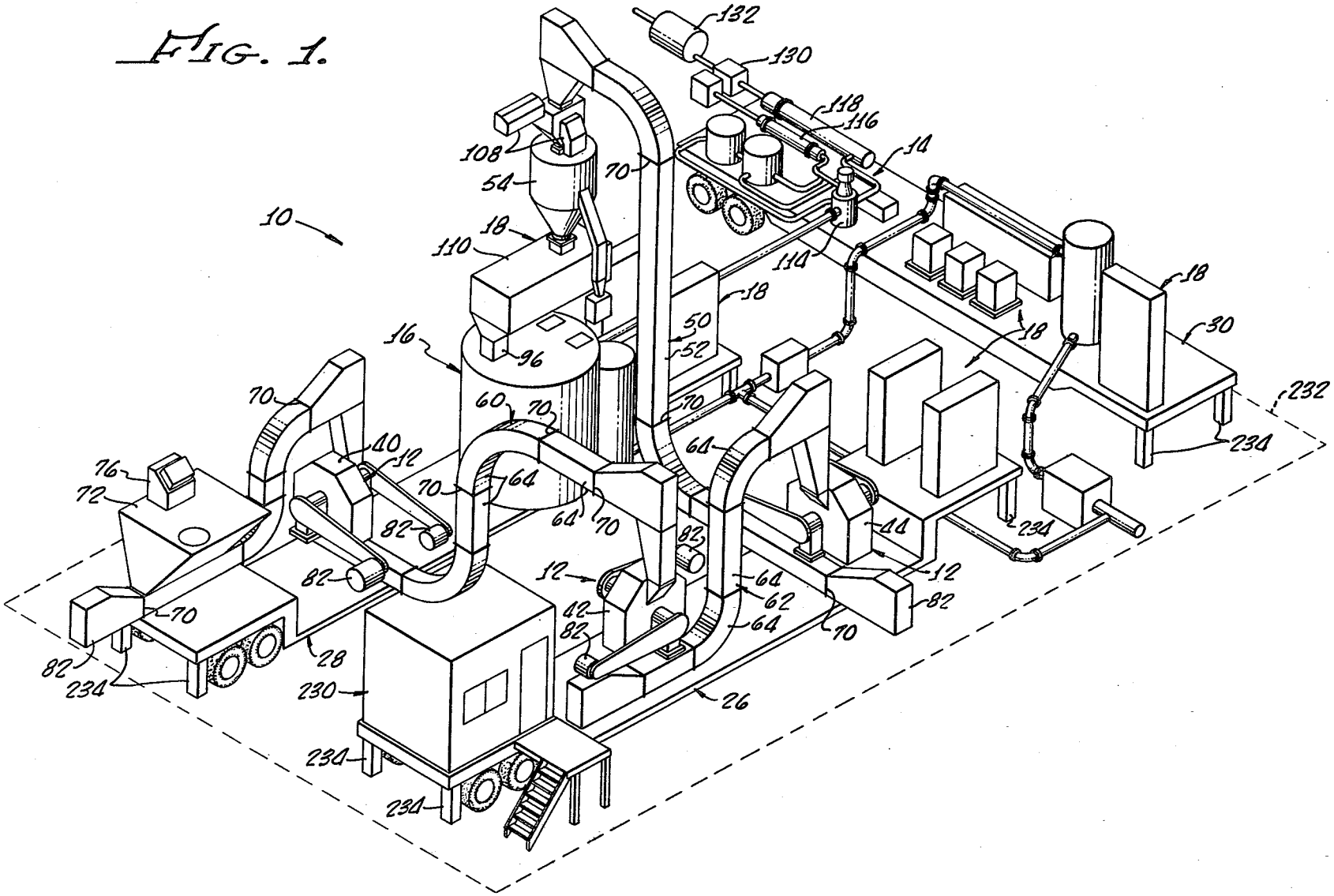
FIG. 1 is a perspective view of the apparatus disposed on three mobile platforms and interconnected for production of COM at a variable output rate.

Referring now to FIG. 1, apparatus 10, in accordance with the present invention, generally includes crushing means, or apparatus, 12, emulsifier means, or apparatus, 14, mixing means, or apparatus, 16, and control means, or apparatus 18, for producing a coal-oil mixture at varying output rates as may be demanded by a user. As hereinafter discussed in greater detail, the apparatus 10 may be configured for disposal on three mobile platforms 26, 28, and 30, which are suitable for transportation over conventional roads and highways.

For clarity of presentation, the mechanical aspects of the crushing apparatus 12 will be discussed separately as will the configuration of the first mixing apparatus 14, and the second mixing apparatus 16 for forming a coal-oil mixture (COM) from the pulverized coal and an oil-water emulsion.

Figure 2:
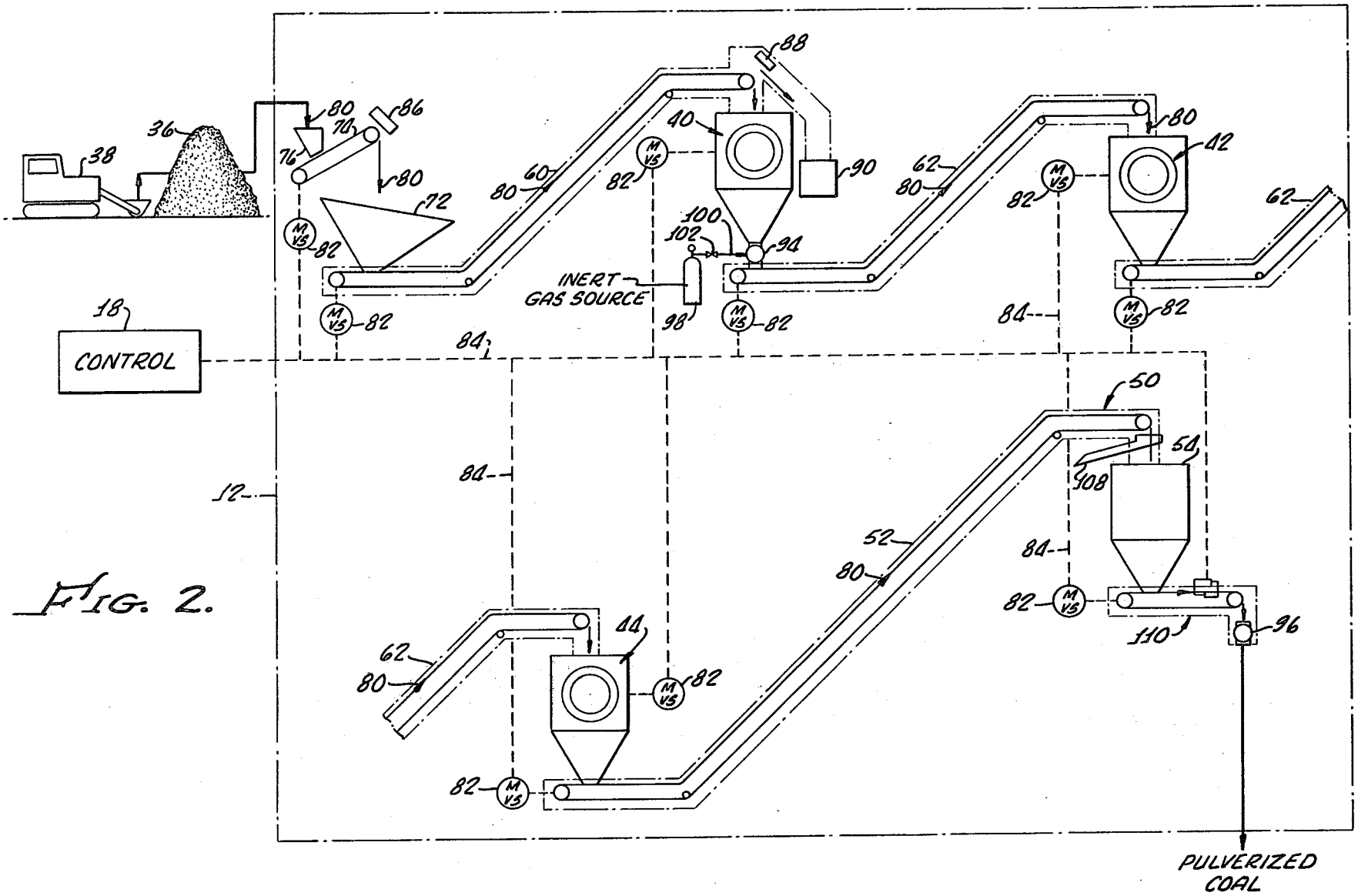
FIG. 2 is a flow diagram showing the handling and preparation of the solid coal; and, FIG. 3 is a flow diagram showing the handling and preparation of the oil-containing liquid component of the COM mixture, and the combining of the coal and the liquid component to form the COM mixture.

The crushing apparatus 12 generally includes a primary crusher 40, a secondary crusher 42, and a tertiary crusher 44, for providing stage-wise crushing of input coal 36, which may be of 2×0 (two inch nominal) size, to pulverized coal, not shown in FIG. 2, of a fineness such that 80% of the pulverized coal will pass through a 200 mesh screen. First conduit means, or apparatus 50, includes a conveyor 52, extending between the mobile platforms 26, 28 (see FIG. 1), and a surge bin 54, for conveying the pulverized coal from the tertiary crusher 44 to the second mixing apparatus 16. As will be hereinafter discussed in greater detail, the conveyor 52 is configured for separation and reconnection between the mobile platforms 26, 28 to enable modular transportation of the apparatus 10 from one site to another on the mobile platforms 26, 28, 30.

Interconnecting the primary, secondary, and tertiary crushers 40, 42, 44 are conveyors 60, 62, the conveyor 60 between the primary and secondary crushers 40, 42 extending between the mobile platforms 26 28, and the conveyor 62 between the secondary and tertiary crushers being disposed on the mobile platform 26. It is to be appreciated that the conveyors 52, 60, and 62 are all configured for separation and reconnection for enabling transportation of the apparatus 10 from one site to another on the first, second, and third mobile platforms 26, 28, 30 over conventional highways.

To facilitate this transportation, all of the apparatus 10, and in particular, the conveyors 52, 60, 62, is sized and configured so that the apparatus 10 may be transported on the first, second, and third mobile platforms 26, 28, 30 with each of said plaforms having an overall shipping envelope having a width of approximately 12 feet, a height of approximately 13 feet, and a length of approximately 60 feet.

The conveyors 52, 60, 62 may be of a conventional commercially available type, and are composed of modular portions 64 with flanges 70, or the like, to enable connection and separation of the modular portions as is well known in the art.

Referring now to FIG. 2, during operation of the apparatus 10, the input coal 36 is loaded into a coal receiving hopper 72 by means of a yard belt 74, chute 76, and the front-end loader 38, the flow of coal 36 in this loading operation and throughout the crushing means 12 being indicated by the direction of material flow arrows 80.

To provide coordinated movement of the coal 36 through the crushers 40, 42 and 44 by means of the conveyors 52 60 62, and to enable the crushing apparatus to produce pulverized coal at a variable rate, variable speed D.C. motors 82 are provided which are controlled by the control apparatus 18 via interconnecting lines 84 by varying the electrical voltages supplied to the D.C. motors in response to an input signal which corresponds to a desired production rate of the coal-oil mixture.

It is to be appreciated that other variable speed electrical motors or devices, not shown, may be employed with appropriate control to effect coordinated movement of the coal 36 through the crushing means 12 to provide pulverized coal at variable rates upon an input or demand signal may be inputted manually, or automatically generated by user's equipment.

Positioned adjacent the yard belt 74 is a permanent magnet 86 which is operative for removing tramp iron from the coal 36 before entry of the coal into the primary crusher 40. The coal is transported from the receiving hopper 72 to the primary crusher via the conveyor 60 passing the coal near a second permanent magnet 88, which is operative for removing any remaining tramp iron from the coal 36 and directing such scrap iron into a scrap iron hopper 90. The primary crusher 40, as well as the secondary and tertiary crushers 42 44 may be typical commercially available cagemill crushers. The primary, secondary, and tertiary crushers 40 42 44 as well as the conveyors 52, 60 and 62 are sized for enabling coal to be pulverized at rates of up to 15 tons per hour.

The primary crusher 40 reduces the size of the coal 36 to approximately $\frac{3}{4}$×0 (three quarter inch nominal) size and such coal is passed through a rotary air lock 94 and onto the conveyor 62 for transportation to the secondary crusher 42. A nitrogen gas purge throughout the conveyors 52 60, secondary and tertiary crushers 42 44 and the surge bin 54 up to a second rotary air lock 96 is provided by interconnection of the air lock 94 to an inert gas, such as nitrogen, source 98 through a line 100 and valve 102.

The control apparatus 18 may include sampling apparatus 108, positioned between the conveyor 52 and the hopper 54 for removing samples of the pulverized coal for screening to determine whether the pulverized coal entering the second mixing means 16 is of uniform preselected fineness. A weigh belt feeder 110 delivers coal from the hopper 54 to the second mixing apparatus 16 at rates determined by the control apparatus 18 in response to input or demand signals which correspond to a desired COM production rate.

The control apparatus 18 may include appropriate conventional material flow rate apparatus, not shown, plus electrical and electronic circuitry, such as a computer, for enabling calculation of coal, oil, flow rates necessary to produce COM at a desired rate.

Figure 3:
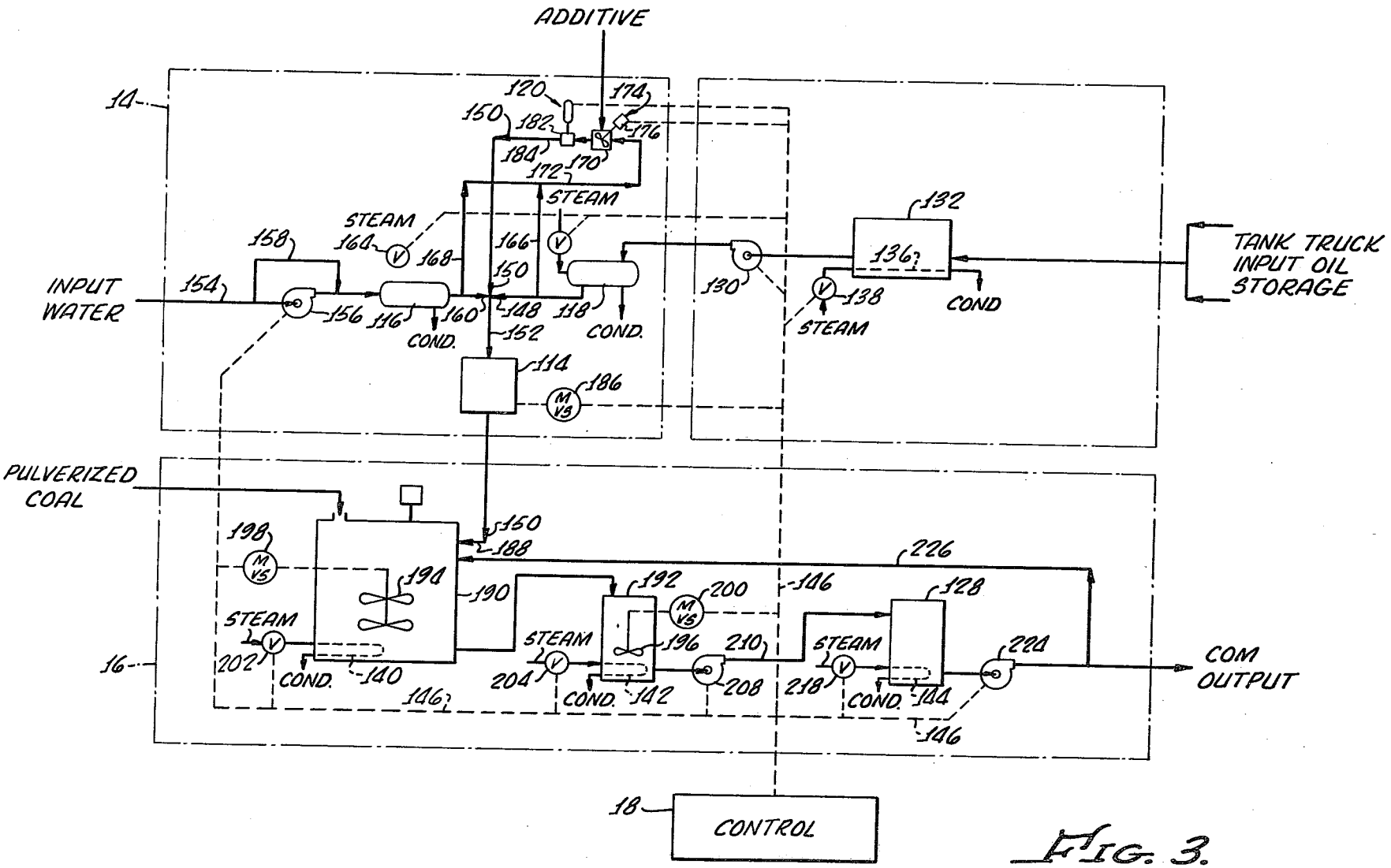

Turning to FIG. 3, there is shown in diagram form the emulsifier apparatus 14 and the mixing apparatus 16 along with a block representation of the control apparatus 18. The emulsifier apparatus 14 generally includes an emulsifier 114, a water heater 116, and an oil heater 118. Apparatus 120 may also be provided for including an additive in the coal-oil mixture which is operative for causing the coal which may settle in a surge tank 128, as for example during temporary shutdown, to be easily resuspended by recirculation as hereinafter discussed in greater detail.

Alternatively, any settling of coal within the second mixing apparatus 16 during shutdown may be prevented by purging the apparatus 16 with oil or oil-water emulsion by suspending addition of pulverized coal into the second mixing apparatus 16.

Oil input to the emulsifier apparatus 14 may be provided by a tank truck or other external supply, not shown, through an input pump 130 interconnected with a storage tank 132 which may have capacity of up to 8,000 gallons. Both the oil pump 130 and the storage tank 132 may be disposed at ground level as shown in FIG. 1 and the storage tank 132 may be heated by means of steam coils 136 (FIG. 3) therethrough, the steam flowing therethrough being regulated by a valve 138 which is remotely controlled by the control apparatus 18.

As shown in FIG. 3, heating of the various mixing and storage tanks is accomplished through the use of steam coils 140,142,144 with the temperature regulation throughout the apparatus 10 being monitored and controlled by the control apparatus 18. Hence, a steam supply, not shown, providing steam at approximately 100 to 150 psig is necessary as well as water, at 15 gallons per minute, and electrical power.

The pump 130 providing oil to the emulsifier apparatus 14 may have a capacity up to 50 gallons per minute and is driven by a variable speed D.C. motor interconnected with the control apparatus as indicated by the dashed lines 146. Entering oil is steam heated by the heater 118 to a temperature of approximately 180° to 270° F. and passed by lines 148 and 152 into the emulsifier 114, arrowheads 150 throughout the diagram of FIG. 3 indicating the direction oil, or water, flow through the interconnecting lines.

Water, at approximately 15 gallons per minute is fed to the emulsifier apparatus 14 via an input line 154 interconnected with a water pump 156 which may be necessary to maintain a water pressure of approximately 20 psi to the emulsifier 114. A bypass line 158 may be provided for use if sufficient pressure is available from time to time without the use of a pump. Pump 156 includes a variable D.C. motor, controlled in a similar manner described earlier in connection with the crushing apparatus 12, by the control apparatus 18. The water, after being heated to a temperature of approximately 150° F. is fed through lines 160 and 152 into the emulsifier 114.

As earlier described in connection with the oil heater 118, steam is provided to the water via a regulating valve 164 which in turn is controlled by the control apparatus 18 to maintain an operating water temperature of approximately 180° F.

A portion of the oil from line 148 and the water from line 160 may be separated into lines 166, 168, respectively, and introduced into an additive mixing tank 170 via line 172. The mixing tank 170 includes mixing apparatus 174 which includes a variable speed D.C. motor 176 controlled by the control apparatus 18. After mixing an additive for the purposes hereinbefore explained, the mixture is returned to the emulsifier 114 via a pump 182 and lines 184 and 152. The water and oil and, if added, the additive, are formed into an emulsion by the emulsifier 114. The emulsifier may be any number of commercially available emulsifiers driven by variable speed D.C. motor 186.

Thereafter, the oil-water emulsion is fed via line 188 into the mixing apparatus 16, which generally includes a primary mixing tank 190, a secondary, or polish, mixing tank 192 and the surge tank 128 for the coal-oil mixture.

The primary and secondary mixing tanks 190, 192 are specifically designed for mixing coal and oil. These tanks typically include propeller type mixers 194, 196, which may be driven by variable speed D.C. motors 198, 200, the speed of mixing being coordinated with the feed rates by the control apparatus 18. Typically, the primary mixing tank 190 may have a capacity of 5000 gallons and the secondary mixing tank may have a capacity of approximately 500 gallons. When the apparatus 10 is operating within an output range of approximately 0 to 3200 gallons per day of coal-oil mixture having a coal content of approximately 30 to 55 percent by weight, the retention time of the coal and oil-water emulsion in the primary and secondary mixing tanks 190, 192 may be as high as approximately 50 minutes.

As shown in FIG. 3, the primary and secondary mixing tanks 190, 192 are heated by steam and temperature controlled by steam valves 202, 204 interconnected with the control apparatus 18. It should be appreciated that included within each of the tanks 190 192 are steam coils 140, 142 along with appropriate temperature sensing apparatus (not shown) in order that a complete servo type loop be established as may be necessary to maintain proper temperature control.

The coal-oil mixture at a temperature of approximately 160° to 180° F. is removed from the secondary mixing tank 192 via a pump 208 and line 210 and introduced to the COM surge tank 128 which may have a capacity of approximately 500 gallons. Included in the surge tank 128 are steam coils 216 to maintain the temperature of the coal-oil mixture at approximately 160° to 180° F., temperature regulation being accomplished as hereinbefore described in connection with the mixing tanks 190 and 192 via a steam regulating valve 218 interconnected with the control apparatus 18.

The surge tank 128 enables the apparatus 10 to provide COM at surge rates for short periods of time with said surge rates being greater than the maximum output of the mixing means 16, which in one embodiment is approximately 3200 gallons per day.

For example, at 3200 gallons per day of COM mixture, the hourly rate is approximately 133 gallons. Hence, a surge tank having a capacity of about 500 gallons could, for example, enable the apparatus 10 to deliver 266 gallons of COM per hour for a period of over 3 hours.

An output pump 224, which may be mounted at ground level, is provided to output the COM at pressures of up to 100 psi and to return COM to the primary mixing tank 190 via the return line 226, such return being necessary from time to time to resuspend any settled coal which may occur in the surge tank 128 upon temporary shut-down of the apparatus 10, or to change the coal content in the COM if desired.

As briefly mentioned earlier, the additive mixed into the oil and water in the additive mixing tanks acts to facilitate resuspension of coal which may settle in the surge tank, or elsewhere in the apparatus, during shutdown periods. Such a flocculent additive as is well known in the art, is operative for causing coal, when settling in the surge tank, primary and secondary mixing tanks 190, 192, and elsewhere in the second mixing apparatus 16, to form a loose flocculent layer which is easily resuspended upon agitation or recirculation to the second mixing apparatus 16.

The control apparatus is constructed in accordance with conventional control design and includes electrical circuitry which may be disposed on the first, second, and third mobile platforms 26, 28, 30, as indicated on FIG. 1. Conventional instrumentation, not shown, indicating flow rates and temperatures may be included and disposed in an operator's room 230, mounted on the first mobile platform 26.

It is to be appreciated that the weight of the tanks 190, 192, the crushers 40, 42, 44 along with the weight of the coal and oil may be significant, hence the mobile platforms 26, 28 and 30 are preferably disposed upon a suitable foundation 232 such as concrete, and that upon assembly of the apparatus 10, support shims 234 are installed under the mobile platforms 26, 28, 30 in order to stabilize the apparatus 10 during start-up and operation.

Although there has been described hereinabove a specific arrangement of apparatus for producing a coal-oil-water mixture in accordance with the invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Apparatus for producing a coal-oil mixture comprising:

crushing means for producing pulverized coal at a variable rate;

mixing means, adapted for connection to an external oil supply and interconnected with said crushing means, for producing a coal-oil mixture at a variable mixing rate, said coal being in suspension in said coal-oil mixture; and control means, configured for receiving input signals corresponding to desired production rates of the coal-oil mixture and in an operative relationship with said crushing and mixing means, for varying the rate of pulverized coal production, and the mixing rate, to produce said coal-oil mixture at rates corresponding to said input signals.

2. The apparatus of claim 1 wherein the crushing and mixing means each include variable speed D.C. motors and the control means is configured for varying electrical voltages supplied to said D.C. motors in response to said input signal.

3. The apparatus of claim 1 or 2 wherein said crushing means, mixing means and said control means are configured for disposal on at least two mobile platforms and said apparatus further includes separable interconnecting conduit means between said crushing means, mixing means and said control means, for enabling transportation of said apparatus from one site to another on said mobile platforms.

4. The apparatus of claim 1 or 2 further comprising at least two mobile platforms, said crushing means, mixing means and said control means being disposed thereon, and separable interconnecting conduit means between said crushing means, mixing means and said control means, for enabling transportation of said apparatus from one site to another on said mobile platforms.

5. The apparatus of claim 1 further comprising surge tank means interconnected with said mixing means for enabling said apparatus to provide the coal-oil mixture at surge rates for short periods of time, said surge rates being greater than a maximum mixing rate of said mixing means.

6. The apparatus of claim 5 further comprising means for facilitating resuspension of settled coal in said surge tank means.

7. Apparatus for producing a coal-oil mixture comprising:

crushing means for producing pulverized coal at a variable rate:

emulsifier means, adapted for connection to external water and oil supplies, for producing an oil-water emulsion at a variable rate;

mixing means for combining the pulverized coal and the oil-water emulsion to produce a coal-oil mixture at a variable mixing rate, said coal-oil mixture including water and said coal being in suspension in said coal-oil mixture;

first conduit means for conveying the pulverized coal to said mixing means, said second conduit means being configured for separation and reconnection for enabling modular transportation of the apparatus from one site to another;

second conduit means for conveying the oil-water emulsion to said mixing means, said second conduit means being configured for separation and reconnection for enabling modular transportation of the apparatus from one site to another;

control means, configured for receiving input signals corresponding to desired production rates of coal-oil mixture and in an operative relationship with said crushing means, emulsifier and mixing means and said first and second conduit means, for varying the rate of pulverized coal production, the variable rate of producing oil-water emulsion and the mixing rate to produce said coal-oil mixture at output rates corresponding to said input signals, said control means including separable interconnecting means between said crushing means, emulsifier and mixing means and said first and second conduit means for enabling modular transportation of the apparatus from one site to another.

8. The apparatus of claim 7 further comprising surge tank means interconnected with said mixing means for enabling said apparatus to provide the coal-oil mixture at surge rates for short periods of time, said surge rates being greater than a maximum mixing rate of said mixing means.

9. The apparatus of claim 8 further comprising means for facilitating resuspension of settled coal in said surge tank means.

10. The apparatus of claim 9 wherein said means for including additive means in said coal-oil mixture includes means for adding said additive into said emulsifier means.

11. The apparatus of claims 1, 2, or 7 wherein the coal-oil mixture is produced at a variable rate output of up to approximately 3200 gallons per day.

12. Apparatus for producing a coal-oil mixture comprising:

crushing means including a primary, secondary and tertiary crusher for producing pulverized coal at a variable rate, said pulverizing means being disposed on a first and a second mobile platform;

emulsifier means, adapted for connection to external water and oil supplies, for producing an oil-water emulsion at a variable rate, said emulsifier mixing means being disposed on a third mobile platform;

mixing means, interconnected with said pulverizing means and said emulsifier means for producing a coal-oil suspension at a variable mixing rate, said mixing means being disposed on said first mobile platform, said coal-oil mixture including water and said coal being in suspension in said coal-oil mixture;

first conduit means for conveying the pulverized coal to said mixing means, said first conduit means being configured for extending between said first and second mobile platforms, said first conduit means being further configured for separation and reconnection for enabling modular transportation of the apparatus from one site to another on the first, second, and third mobile platforms;

second conduit means for conveying the oil-water emulsion to said second mixing means, said second conduit means being configured for extending between said second and third mobile platforms, said second conduit means being further configured for separation and reconnection for enabling modular transportation of the apparatus from one site to another on the first, second and third mobile platforms;

third conduit means for conveying coal interconnecting the primary, secondary and tertiary crushers, said third conduit means being configured for extending, in part, between the first and second mobile platforms, said third conduit means being further configured for separation and reconnection for enabling modular transportation of the apparatus from one site to another on said first, second and third mobile platforms; and, control means, configured for receiving input signals corresponding to desired production rates of coal-oil mixture and in an operative relationship with said crusher, emulsifier and second mixing means, and first, second and third conduit means for varying the rate of pulverized coal production, the rate of emulsification and the mixing rate to produce said coal-oil mixture at output rates corresponding to said input signals, said control means being disposed on said first, second and third mobile platforms and including separable interconnection means between said pulverizing means, emulsifier and mixing means and said first, second, and third conduit means for enabling modular transportation of the apparatus from one site to another on said first, second and third mobile platforms.

13. The apparatus of claim 12 wherein the pulverizing, emulsifier mixing and first, second, and third conduit means include variable speed D.C. motors interconnected with said control means.

* * * * *